United States Patent [19]

Libertini

[11] 4,264,271

[45] Apr. 28, 1981

[54] IMPELLER SHROUD OF A CENTRIFUGAL COMPRESSOR

[75] Inventor: Zoltan L. Libertini, Stamford, Conn.

[73] Assignee: Avco Corporation, Stratford, Conn.

[21] Appl. No.: 20,566

[22] Filed: Mar. 15, 1979

[51] Int. Cl.[3] ..... F01D 5/08

[52] U.S. Cl. ..... 415/170 A; 415/134; 415/174

[58] Field of Search ..... 415/134, 170 A, 174

[56] References Cited

U.S. PATENT DOCUMENTS

| | | | |
|---|---|---|---|
| 3,384,345 | 5/1968 | Neath et al. | 415/134 X |
| 3,425,665 | 2/1969 | Lingwood | 415/134 X |

FOREIGN PATENT DOCUMENTS

| | | | |
|---|---|---|---|
| 47-50685 | 12/1972 | Japan | 415/174 |

*Primary Examiner*—Billy J. Wilhite
*Attorney, Agent, or Firm*—Ralph D. Gelling

[57] ABSTRACT

The shroud or stationary housing for the impeller of a centrifugal compressor includes inherent means for selectively controlling the displacement thereof during operation of the centrifugal compressor, and in a manner to substantially maintain uniform spacing or clearance between the shroud and the blade tips of the rotating impeller in order to achieve improved performance at both part and full power operating conditions. The shroud is preferably formed of a unitary member including an annular, concave disc portion substantially corresponding to the configuration of the tips of the blades of the impeller, with the annular concave disc portion being rigid and connected to a fixed flange support portion by a flexible, annular diaphragm which extends generally perpendicular to the shaft of the impeller. The annular diaphragm is sufficiently flexible such that during operation of the centrifugal compressor, the differential thermal and pressure forces generated along the length of the blades within the compressor cause deformation of the flexible diaphragm and a substantially linear movement of the rigid, concave disc portion relative to the flange support portion. The movement of the annular concave disc portion substantially corresponds to the change in configuration of the blades, thereby minimizing blade tip losses.

5 Claims, 3 Drawing Figures

IMPELLER SHROUD OF A CENTRIFUGAL COMPRESSOR

The subject invention relates to a new and improved shroud for the impeller of a centrifugal compressor, and more particularly a shroud having a unitary support including a flexible diaphragm portion which controls the axial and radial positioning of the shroud during operation of the centrifugal compressor so as to substantially maintain uniform tip clearance between the shroud and the blade tips at part and full power operating conditions of the centrifugal compressor.

In a typical centrifugal compressor, the air flowing through the impeller is increased in temperature on the order of 300° to 400° F. This differential temperature rise occurs over the relatively short span of the length of the blades of the impeller, and a corresponding increase of pressure is also experienced by the air flowing through the impeller. By virtue of the increase in temperature of the gases passing through the impeller, the downstream or radially outer tip end of each blade of the impeller is subjected to higher temperatures than the temperatures at the input or radially inner root end of the impeller. The effect of this temperature differential is a warping of the impeller such that the radially outer tip portions of the blades tend to lean or propogate in an upstream direction toward the surface of the juxtaposed shroud of the compressor. To further compound this temperature differential is the additional heat provided to the radially outer tip portions of the blades by the heat radiated by the turbine section of the gas turbine engine to the backside of the impeller. This additional heat increases the temperature differential and results in further leaning of the blade tips toward the shroud.

The pressure differential brought about by the increased pressure of the gases at the blade tips also generates forces tending to lean or force the blade tips in an upstream direction toward the juxtaposed shroud. Accordingly, in prior art shroud constructions where the shroud is designed to be spatially fixed relative to the impeller, it is apparent that the differential temperature and pressure forces acting along the lengths of the blades will result in a variation in the spacing or clearance between the blades and the shroud under the different operating conditions of the centrifugal compressor, In other words, whereas the clearance between the radially inner root portions of the blades and the shroud will remain fairly constant under various operating conditions of the compressor (since the temperature and pressure of the gases at that location are fairly low), the clearance at the blade tips will constantly vary in response to changing operating conditions of the compressor.

Another factor contributing to the leaning of the blade tips in the upstream direction is the centrifugal effect brought about by the high speed rotation of the impeller. Accordingly, during operation of a centrifugal compressor, a differential spacing could result between the shroud and the blade tips along the length thereof, and this differential spacing may cause a decrease in efficiency and a performance loss of the operation of the centrifugal compressor.

Heretofore, in order to compensate for the anticipated leaning or relative movement of the radially outer blade tips relative to the upstream root portions of the blades, it has been common to design the shroud so as to provide an enlarged clearance space between the shroud and the blade in order to obviate rubbing of the blade tips with the shroud, and in order to attempt to obtain generally uniform spacing between the blade tips and the shroud at one operating condition (e.g., full power) of the centrifugal compressor. Accordingly, heretofore, the shroud mounting has been designed so as to include a rigid mounting arrangement such that the shroud, during operation of the centrifual compressor, remains spatially fixed, and at a sufficient distance from the blade tips such that upon movement of the blade tips, the gap or clearance between the shroud and the blade tips may be decreased to an acceptable limit. As is readily apparant, with this arrangement, at operating conditions other than the designed operation condition, the clearance between the blade tips and the shroud is greater than is desirable, thus resulting in a loss of performance in the operation of the centrifugal compressor.

Accordingly, it is an object of the subject invention to provide a new and improved shroud having an integral support in the form of a flexible diaphragm which influences the axial and radial positioning of the shroud, and which is effective to position the shroud relative to the rotating impeller to achieve substantially uniform clearance between the shroud and the blade tips at various operating conditions of the centrifugal compressor.

It is a further object of the subject invention to provide a new and improved shroud having a mounting arrangement which is flexible and is automatically responsive to differential pressure and temperature conditions within the centrifugal compressor for achieving improved performance of the centrifugal compressor at both part and full power.

The above and further objects of the invention are achieved by the shroud of the subject invention which includes an annular, concave disc portion which is spaced from the impeller blades, a fixed, flange support portion, and an annular, flexible diaphragm extending between said annular, concave disc portion and the flange support portion. The annular diaphragm is connected to the annular, concave disc portion at a point intermediate the width thereof, and in response to differential pressure and temperature conditions generated within the centrifugal compressor, by virtue of the inherently rigid construction of the annular, concave disc portion, the forces acting thereon are trasnmitted through the flexible annular diaphragm to the fixed flange support portion of the shroud. The forces are effective in deforming the annular, flexible diaphragm such that the latter causes a corresponding axial and radial repositioning of the annular, concave disc portion relative to the blade tips, and in a direction to correspond to the leaning or propagation of the blades, thereby maintaining a uniform clearance between the shroud and the blade tips, and a corresponding improved performance of the centrifugal compressor. Preferably, the shroud of the subject invention is formed of a unitary member, and the annular diaphragm extends generally perpendicular to the rotating shaft of the impeller.

Further objects and advantages of the invention will become apparant from a reading of the following detailed description taken in conjunction with the drawings in which.

Figure 1:
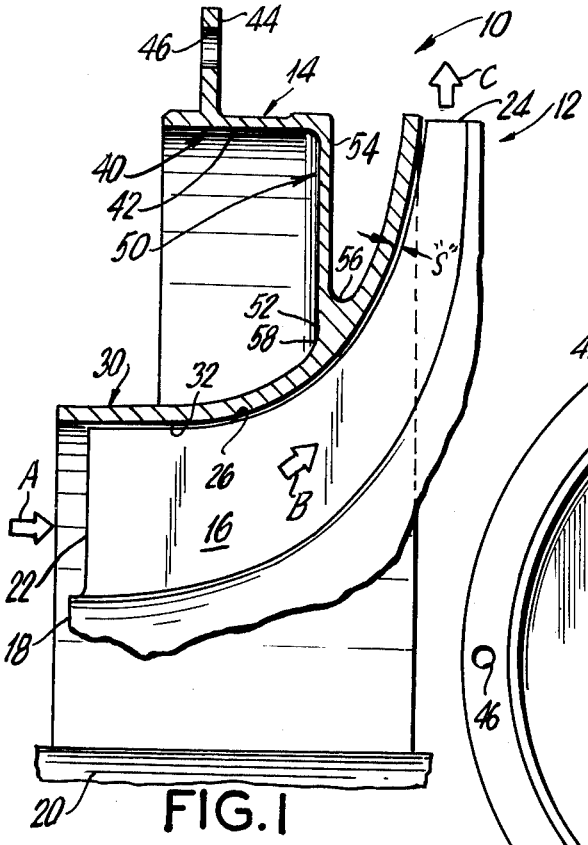
FIG. 1 is a partial sectional view of a centrifugal compressor and the shroud of the subject invention.
Figure 2:
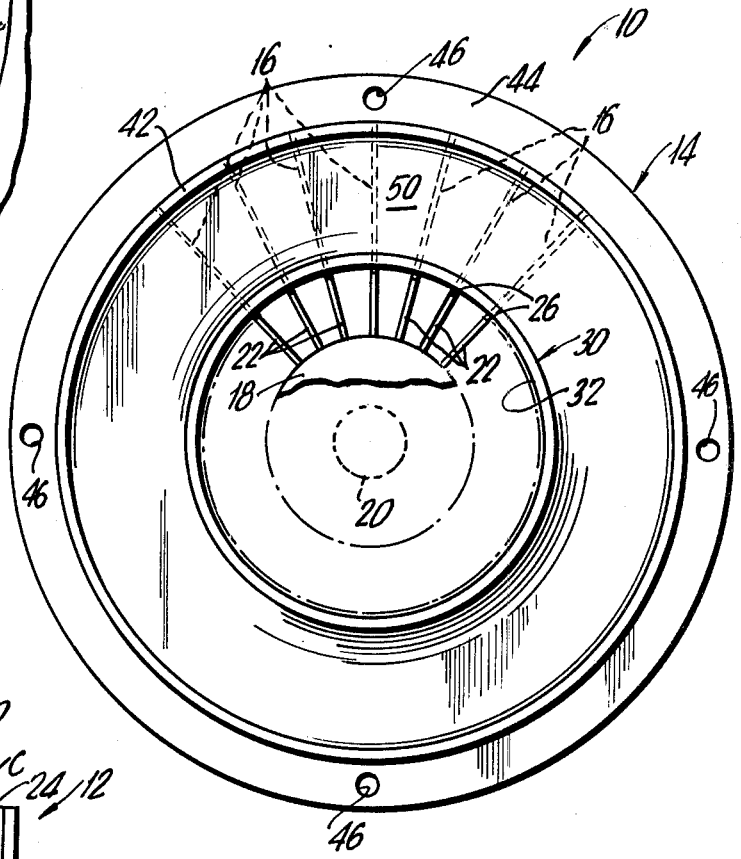
FIG. 2 is a frontal view of the shroud of the subject invention.

Referring to FIGS. 1 and 2, the centrifugal compressor 10 of a gas turbine engine basically comprises an impeller 12 and a shroud 14. The impeller 12 includes a plurality of radially extending, spaced blades 16 mounted about a central hub 18, with the shaft of the impeller being designated by the numeral 20. The longitudinal axis of shaft 20 substantially corresponds with the input air flow, designated by the arrow A provided to the centrifugal compressor from the air inlet (not shown) of the gas turbine engine. Each blade 16 is curved along its length extending radially from the inner root end 22 to the outer tip portion 24 from which the high speed, high temperature air flow is provided to the diffuser (not shown) of the centrifugal compressor 10. As the air flow is passed through the impeller 12 its direction is changed from being generally aligned parallel to the impeller shaft 20 (arrow A), through an intermediate stage (arrow B), and finally in a radially outward direction (arrow C) which is generally peripendicular to the longitudinal axis of the impeller shaft 20. As the air flow is compressed and redirected in the centrifugal compressor, the temperature and pressure of the air flow is increased from the root end 22 to the tip end 24 of a blade 16 thereby giving rise to differential thermal and pressure forces acting on the impeller 12. As a result of these forces, the tip portions 24 of the blades 16 tend to lean or propagate in a direction upstream, or to the left as shown in FIG. 1, toward the shroud 14. On the other hand, since the input airflow A to the compressor 10 is relatively cool and unpressurized, there are relatively low forces tending to move the root ends 22 of the blades 16 relative to the shroud 14.

Shroud 14 basically comprises an annular, concave disc portion 30, a flange support portion 40, and an intermediate, flexible diaphragm 50. The shroud is preferably formed of a unitary machined member with the felxible diaphragm being of a ring-like configuration having an inner diameter portion 52 and an outer diameter portion 54. The concave disc portion 30 is a body of revolution having an inner surface 32 juxtaposed to the longitudinally extending edges 26 of the blades 16. The spacing or clearance between the inner surface 32 of the annular, concave disc portion 30 of the shroud 14 and the longitudinally extending edges 26 of the blades is designated by the letter "S". The flexible diaphragm 50 is connected to the annular, concave disc portion 30 as at its inner diameter portion 52 at a point located intermediate the width of the disc 30. Preferably, the connection includes fillers 56 and 58 for minimizing stress concentration points brought about by bending of the flexible diaphragm 50 during operation of the centrifugal compressor, as more fully described hereinafter.

The flange support portion 40 of shroud 14 includes a cylindrical portion 42 having a central axis disposed generally parallel to the axis of the impeller shaft 20 and connected to the outer diameter portion 54 of the flexible diaphragm 50. An annular flange support 44 extends perpendicular to cylinder 42 and includes spaced holes 46 for receiving bolts (not shown) in order to connect the flange support portion 40 to hard points on the gas turbine engine. By this arrangement, the flange support 40 is fixed with respect to the impeller 12. Likewise, by virtue of the curvature and body of revolution of the annular concave disc 30, the latter is relatively rigid in configuration and is resistant to bending or distortion about its periphery upon the development of differential pressure and temperature forces within the centrifugal compressor 10. On the other hand, the ring-shaped intermediate diaphragm 50 is designed to be flexible in order to provide inherent capability of the shroud 14 to react to the differential temperature and pressure forces developed within the compressor 10 for varying the disposition of concave disc 30 during the various operating conditions of the compressor 10.

Figure 3:
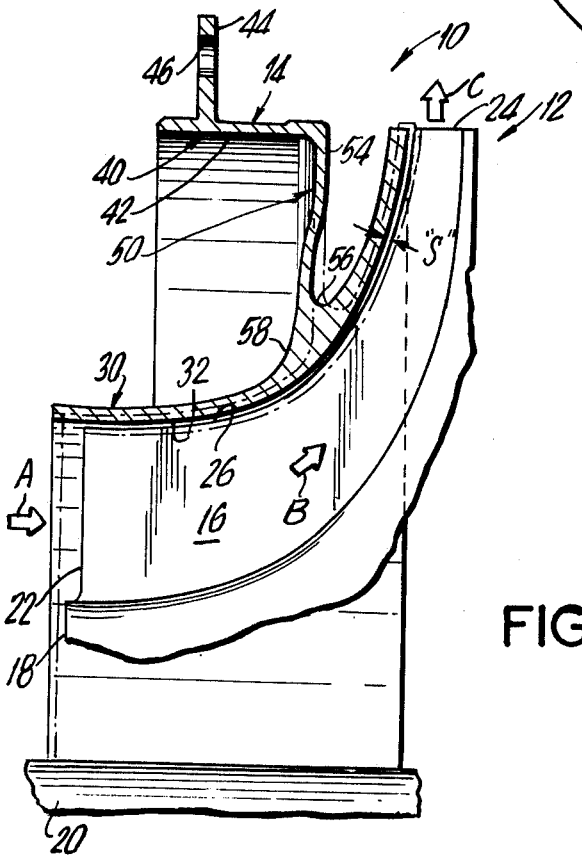
FIG. 3 is a view of the shroud of the subject invention as in FIG. 1 but illustrating the displaced position of the shroud during operation of the centrifugal compressor as shown in full lines, with the initial position of the shroud being indicated in dotted lines.

In order to minimize blade tip losses and maintain efficiency pf a centrifugal compressor at all operating conditions, it is imperative that the tip clearance (corresponding to the spacing "S" shown in FIG. 1) remain substantially constant along the entire length of the blades (corresponding to edge 26). The shroud 14 of the subject invention achieves this objective by virtue of the arrangement of the flexible diaphragm 50 interconnecting the fixed, flange support portion 40 to the inherently rigid, annular concave disc portion 30. More particulary, referring to FIG. 3, during operation of the centrifugal compressor 10, the thermal and pressure forces developed by virtue of the compression and acceleration of the gas flow from the root end 22 to the radially outer tip 24 of the blade 16, as designated by the arrows A, B, and C causes a pressure force to be applied to the annular concave disc portion 30 in a direction pointing toward the upstream end of the gas turbine engine, i.e., toward the left side of the centrifugal compressor 10 as viewed in FIG. 3. Since the annular concave disc portion 30 is inherently rigid by virtue of its configuration, the forces applied to the disc portion 30 are transmitted through the flexible diaphragm 50 to the relatively spatially fixed support flange 40, thereby giving rise to deformation of the flexible diaphragm 50, as shown in solid lines in FIG. 3. The original, non-distorted position of the flexible diaphragm is shown in dotted lines. As noted in FIG. 3, by virtue of the radial and axial movement of the entire annular concave disc portion 30 relative to the edges 26 of the blades, the disc portion 30 is moved in a direction corresponding to the leaning or growth of the blades 16 during operation of the compressor 10. More particularly, by virtue of the disposition of the flange support portion 40, and in particular the parallel relationship of cylinder portion 42 to the shaft 20, and the perpendicular relationship of flexible diaphragm 50 to elements 42 and 20, the concave disc portion 30 is forced upstream away from the blades tips 24 (which are leaning in the same direction) and slightly radially outwardly which substantially corresponds to the overall thermal growth of the blades 16 at their root ends 24 and intermediate portions. As illustrated in FIG. 3, under the influence of the thermal and pressure forces generated within the compressor, the flexible diaphragm assumes a generally S-shaped configuration as it is bent or distorted between the rigid connection of the flange support and the inherently rigid construction of the annular, concave disc portion of the shroud. Accordingly, the clearance "S" between the justaposed inner surface 32 of concave disc portion 30 and the edges 26 of the blades 16 is maintained fairly constant.

There is an additional growth of the shroud 30 at its downstream end which results in a curling motion away from the blades tips 24 and provides an increased clearance to further accommodate expansion of the impeller. This is caused by the greater differential increase in temperature of the portion of the shroud downstream of the support point on the diaphragm and because the shroud is not fixed at its downstream end.

In summary, the subject invention provides a new and improved shroud for the impeller of a centrifugal compressor which has the advantage of improved build and running clearances between the rotating and stationary parts, and thus improved performances at part and full power operating conditions. The flexible diaphragm is deformed in response to differential forces developed in the compressor, and such deformation effects desirable axial and radial repositioning of the juxtaposed annular, concave disc portion of the shroud relative to the blades in order to maintain efficiency of the compressor.

Although the invention has been described and illustrated with reference to a preferred embodiment thereof, it is readily apparent that alterations, changes, or modifications may be made therein without departing from the spirit and scope of the invention as defined by the appended claims.

What is claimed is:

1. A shroud for the impeller of a centrifugal compressor wherein the shaft of said impeller is generally aligned with the air flow, said shroud comprising:

a rigid, annular concave disc portion substantially corresponding to the configuration of the tips of the blades of the impeller and spaced therefrom;

a flexible, annular diaphragm of a generally flattened, ring configuration having an inner and outer diameter, said diaphragm extending generally peripendicular to the shaft of the impeller, with the inner diameter of said diaphragm being connected to the annular concave disc portion intermediate the width thereof; and a flange support portion connecting the flexible diaphragm to a fixed support frame, extending generally parallel to the shaft of said compressor and connected to the outer diameter of said flexible, annular diaphragm whereby, during operation of the centrifugal compressor, the differential thermal and pressure forces developed within the compressor cause a deformation of the flexible diaphragm and a corresponding displacement of said annular, concave disc portion relative to the flange support portion so as to maintain substantially uniform clearance between said annular concave disc portion and the blade tips.

2. A shroud for the impeller of a centrifugal compressor wherein the shaft of said impeller is generally aligned with the air flow as in claim 1 wherein said shroud is formed of a unitary member.

3. A shroud for the impeller of a centrifugal compressor wherein the shaft of said impeller is generally aligned with the air flow as in claim 1, wherein said flange support portion includes a first cylinder portion extending generally parallel to the impeller shaft and an apertured support connected adjacent one end thereof and extending peripendicular thereto, said apertured support being connected to the frame.

4. In combination with a centrifugal compressor, said centrifugal compressor including an impeller, the shaft of which is aligned with the air flow to the compressor, a shroud enveloping and spaced from the edges of the blades of said impeller, said shroud comprising:

a rigid, annular concave disc portion, the inner surface of which is juxtaposed to the edges of the blades of the impeller;

a flexible, annular diaphragm of a generally flattened, ring configuration having an inner diameter and an outer diameter, said flexible diaphragm extending generally peripendicular to the shaft of the impeller, with the inner diameter of said diaphragm being rigidly connected to the annular concave disc portion intermediate the length thereof; and a flange support portion connecting the flexible diaphragm to a fixed support frame, said flange support portion including a cylinder portion extending generally parallel to the impeller shaft and an apertured support portion connected adjacent one end thereof and extending perpendicular thereto, said apertured support being connected to the frame whereby, during operation of the centrifugal compressor, the differential thermal and pressure forces developed within the compressor cause deformation of the flexible diaphragm and a corresponding axial and radial displacement of said annular, concave disc portion relative to the frame so as to maintain substantially uniform clearance between the annular concave disc portion and the juxtaposed blade edges.

5. The combination of claim 4 wherein said shroud is a unitary member.

* * * * *